US012276111B2

(12) United States Patent
Thompson et al.

(10) Patent No.: US 12,276,111 B2
(45) **Date of Patent: *Apr. 15, 2025**

(54) BUILDING RIDGE VENT SYSTEM

(71) Applicant: American Flashings and Accessories, LLC, Bailey, MI (US)

(72) Inventors: Leon W. Thompson, Kent City, MI (US); Jacob M. Thompson, Grant, MI (US)

(73) Assignee: American Flashings and Accessories, LLC, Bailey, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/619,471

(22) Filed: Mar. 28, 2024

(65) Prior Publication Data

US 2024/0240464 A1 Jul. 18, 2024

Related U.S. Application Data

(63) Continuation of application No. 17/683,814, filed on Mar. 1, 2022, now Pat. No. 11,965,339, which is a continuation of application No. 29/817,795, filed on Dec. 3, 2021, now Pat. No. Des. 1,037,495.

(60) Provisional application No. 63/162,646, filed on Mar. 18, 2021.

(51) Int. Cl.
*E04D 13/17* (2006.01)

(52) U.S. Cl.
CPC ..... *E04D 13/174* (2013.01)

(58) Field of Classification Search
CPC ..... E04D 13/174; E04D 13/176; E04D 13/17; E04D 2001/309; F24F 7/02
USPC ..... 52/199; 454/365, 366, 367
See application file for complete search history.

(56) References Cited

U.S. PATENT DOCUMENTS 2,799,214 A * 7/1957 Roose ..... E04D 13/174 454/365
4,280,399 A * 7/1981 Cunning ..... E04D 13/174 454/365
4,554,862 A * 11/1985 Wolfert ..... F24F 7/02 52/517
4,676,147 A * 6/1987 Mankowski ..... E04D 13/174 454/365
4,817,506 A * 4/1989 Cashman ..... E04D 13/174 454/365
4,903,445 A * 2/1990 Mankowski ..... F24F 7/02 454/365
4,957,037 A * 9/1990 Tubbesing ..... F24F 7/02 454/366
4,962,692 A * 10/1990 Shuert ..... E04D 13/174 454/365
5,052,286 A * 10/1991 Tubbesing ..... F24F 7/02 454/365

(Continued)

*Primary Examiner* — Kyle J. Walraed-Sullivan
(74) *Attorney, Agent, or Firm* — Warner Norcross + Judd LLP

(57) ABSTRACT

A ridge vent system is provided including a ridge vent having opposing exterior sidewalls that each define multiple fastener recesses that extend inward from the exterior sidewalls and downward from a top plate, where each recess can have multiple recess slots that cooperate with adjacent sidewall slots to form contiguous vented areas along each of the opposing exterior sidewalls to provide enhanced attic ventilation and/or airflow through the ridge vent, while still providing fastener recesses that facilitate rapid and efficient application of fasteners therethrough.

19 Claims, 8 Drawing Sheets

(56) References Cited

U.S. PATENT DOCUMENTS 5,070,771 A * 12/1991 Mankowski ..... E04D 13/174 454/367
5,095,810 A * 3/1992 Robinson ..... F24F 7/02 454/366
5,122,095 A * 6/1992 Wolfert ..... F24F 7/02 454/365
5,149,301 A * 9/1992 Gates ..... E04D 13/174 454/365
5,728,000 A * 3/1998 Bateman ..... F24F 7/02 454/270
5,797,222 A * 8/1998 Martin ..... E04D 13/174 454/365
6,128,869 A * 10/2000 Brotherton ..... F24F 7/02 52/302.1
6,233,887 B1 * 5/2001 Smith ..... E04D 13/176 52/198
6,277,024 B1 * 8/2001 Coulton ..... F24F 7/02 454/365
6,793,574 B1 * 9/2004 Robinson ..... F24F 7/02 454/364
7,735,287 B2 * 6/2010 Gaudreau ..... E04D 3/365 52/525
8,549,802 B2 * 10/2013 Thagard, III ..... B29C 44/02 52/275
9,175,480 B1 * 11/2015 Polston ..... E04D 13/174
2002/0016150 A1 * 2/2002 Hansen ..... E04D 13/174 454/365
2002/0100232 A1 * 8/2002 Robinson ..... E04D 13/176 454/366
2005/0054284 A1 * 3/2005 Ciepliski ..... E04D 13/176 454/365
2006/0196130 A1 * 9/2006 Mantyla ..... E04D 13/174 52/198
2006/0229010 A1 * 10/2006 Villela ..... F24F 7/02 454/365
2007/0039252 A1 * 2/2007 Railkar ..... E04D 13/002 52/44
2007/0072540 A1 * 3/2007 Ciepliski ..... E04D 13/174 454/365
2008/0064320 A1 * 3/2008 Polston ..... E04D 13/174 454/365
2008/0287053 A1 * 11/2008 Carlson ..... E04D 13/174 454/365
2008/0287054 A1 * 11/2008 Carlson ..... E04D 13/174 454/365
2009/0025316 A1 * 1/2009 Coulton ..... F24F 7/02 454/365
2009/0049769 A1 * 2/2009 Kaseda ..... E04D 13/174 52/745.16
2011/0195655 A1 * 8/2011 Holland ..... E04D 13/174 454/365
2011/0302852 A1 * 12/2011 Grubka ..... E04D 1/30 52/302.1
2013/0074428 A1 * 3/2013 Allen ..... E04D 13/174 52/302.1
2014/0273808 A1 * 9/2014 Mankowski ..... E04D 13/176 454/365
2014/0308891 A1 * 10/2014 Holland ..... E04D 13/174 454/365
2016/0201332 A1 * 7/2016 Fiser ..... E04D 13/174 454/365
2016/0215500 A1 * 7/2016 Van Noort ..... E04D 13/174
2016/0333574 A1 * 11/2016 Grubka ..... E04B 7/022
2016/0369513 A1 * 12/2016 Van Wey ..... F24F 7/02
2017/0321933 A1 * 11/2017 Kvasnicka ..... E04F 13/18
2017/0350127 A1 * 12/2017 Lowe ..... E04D 13/174
2019/0136537 A1 * 5/2019 Henning ..... E04D 1/30
2019/0249440 A1 * 8/2019 Hendricks, Jr. ..... E04D 13/174
2020/0018071 A1 * 1/2020 Holland ..... E04D 13/174
2022/0298798 A1 * 9/2022 Thompson ..... E04D 13/174
2023/0126169 A1 * 4/2023 Thompson ..... F24F 7/02 52/199
2023/0130279 A1 * 4/2023 Thompson ..... E04D 13/174 454/365
2023/0228092 A1 * 7/2023 Robida ..... E04D 13/17 454/365
2023/0313533 A1 * 10/2023 Vega-Gutierrez ..... E04D 3/361 52/58

* cited by examiner

BUILDING RIDGE VENT SYSTEM

BACKGROUND OF THE INVENTION

The present invention relates to vents, and more particularly to a roof ridge vent system that ventilates a roof of a building.

Many building roofs are outfitted with vents to promote ventilation and evacuate heat and moisture from the upper extremities of buildings. A common type of vent for building roofs is a ridge vent, which is installed over an opening, typically defined at the peak or ridge of a roof, where two roof surfaces come together. Such ridge vents usually are installed end to end along a length of a ridge of a roof. These ridge vents also are nailed down to the roof with nails to hold them securely in place for a long time.

For many years, ridge vents have been installed using a hammer to manually drive the nails, however, recent advancements in ridge vents have allowed installers of ridge vents to install "sticks" or sections of ridge vents with a nail gun. An example of such a ridge vent that is installable with a nail gun is shown in U.S. patent Application 2019/0136537 to Henning, which is hereby incorporated by reference in its entirety. This reference uses a series of ports along edges of a ridge vent that have a shape that permits access by the head of a nail gun so that the ridge vent can be installed using the nail gun, which drives a nail through each of the ports. While this design is helpful, it negates the efficiency of such ridge vents with the positioning of the ports, and their obstruction of airflow venting. Indeed, the amount of airflow provided by such a ridge vent can be decreased by up to 10% or more in some cases over conventional ridge vents without the nail gun ports. This restriction can present a significant issue, particularly where the ridge vent is installed on a building within a municipality having building codes that mandate a particular amount of airflow through the ridge vent from attic space under the roof. With the decreased airflow, in some cases, the ridge vents might not pass code, in which case the ridge vents may need to be removed or modified at a great expense and effort to the installer, builder and/or owner.

Accordingly, there remains room for improvement in the field of venting for roofs, and in particular ridge vent systems.

SUMMARY OF THE INVENTION

A ridge vent system is provided including a ridge vent having opposing exterior sidewalls that each define multiple fastener recesses that extend inward from the exterior sidewalls and downward from a top plate. Each recess can have multiple recess venting slots that cooperate with adjacent sidewall venting slots to form contiguous vented areas along each of the opposing exterior sidewalls. This can provide enhanced attic ventilation and/or airflow through the ridge vent, while still providing fastener recesses that facilitate rapid and efficient application of fasteners therethrough, optionally via automatic nail or screw guns.

In one embodiment, the ridge vent can include a body including a top plate extending from a first side toward a second side. The top plate can include a first top plate side, a second top plate side and a bending region between the sides. This bending region can overlap a longitudinal axis of the body, and can allow the first and second top plate sides to move and change an angular orientation relative to one another, to thereby accommodate adjacent roof surfaces at a peak or ridge of a roof.

In another embodiment, each recess that accommodates a fastener can be bounded by a nailing flange or bottom wall and a recess wall extending from the bottom wall to the top plate. This recess wall can define multiple air venting slots between the bottom wall and the top plate. These slots can be located between sets of sidewall slots defined by a sidewall, with the air venting slots and the sidewall venting slots providing a contiguous vented area along the respective sidewall and the recess walls of each recess.

In still another embodiment, multiple contiguous vented areas of multiple ridge vents placed over an opening in a roof surface provide an attic ventilation area. This system of ridge vents can thus provide ventilation to a building at a minimum of at least 1 square foot of attic ventilation area for every 300 square feet of attic floor space.

In yet another embodiment, the ridge vent can include a lip extending away from the exterior sidewall. An end wall can extend upward from the first lip, opposite the multiple sidewall slots. The end wall and/or the lip can define multiple drain holes intermittently disposed along the end wall and/or the lip. These drain holes can allow liquid to efficiently drain from the ridge vent.

In even another embodiment, drain holes can be disposed directly in front of and/or aligned with each of the fastener recesses to prevent or impair pooling of liquid in the fastener recesses.

In a further embodiment, each fastener recess can be configured to include a landing pad or target region having a thickness that is greater than other portions of the recess or ridge vent in general. For example, a target region can include a thickness greater than a remaining portion of the nailing flange or recess. The target region with increased thickness can withstand damage due to a fastener penetrating the nailing flange with force.

In still a further embodiment, the target region can be bounded by a perimeter. The perimeter can include an indicia element and/or a step that provides a visual que for a user to identify the location of the target region and advance a fastener through the target region rather than other portions of the fastener recess or nailing flange. The indicia can be a raised or recessed feature along the perimeter, optionally with alphanumeric characters indicating some instructions to the user.

The current embodiments provide a ridge vent and system that can efficiently cap an opening in a roof at two adjoining roof surfaces, and efficiently allow transfer of air from and ventilation of an attic space under the roof and system. Where the ridge vent includes the fastener recesses, an installer can rapidly and quickly use an automated tool, such as a nail gun, screw gun and/or stapler to secure the ridge vent to the roof. The nailing flange or bottom wall of the recesses can directly engage the roof, and can be pinned against the roof surface with the fastener without collapsing the ridge vent air space around the recesses with that fastener. The system can allow easy and quick installation, as well as even fastener spacing when securing the ridge vent to the roof. The system also can enhance overall airflow from an attic space under the roof where the fastener recess walls themselves include airflow ventilation slots. These slots can further cooperate with airflow or venting slots in outer sidewalls of the body of the ridge vent, which otherwise would be interrupted by the fastener recesses, thereby decreasing the ventilation area of the ridge vents. Despite having high airflow characteristics, the ridge vent can be low profile, which can make it less likely to be torn, damaged or blown off a roof under high winds.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 3:
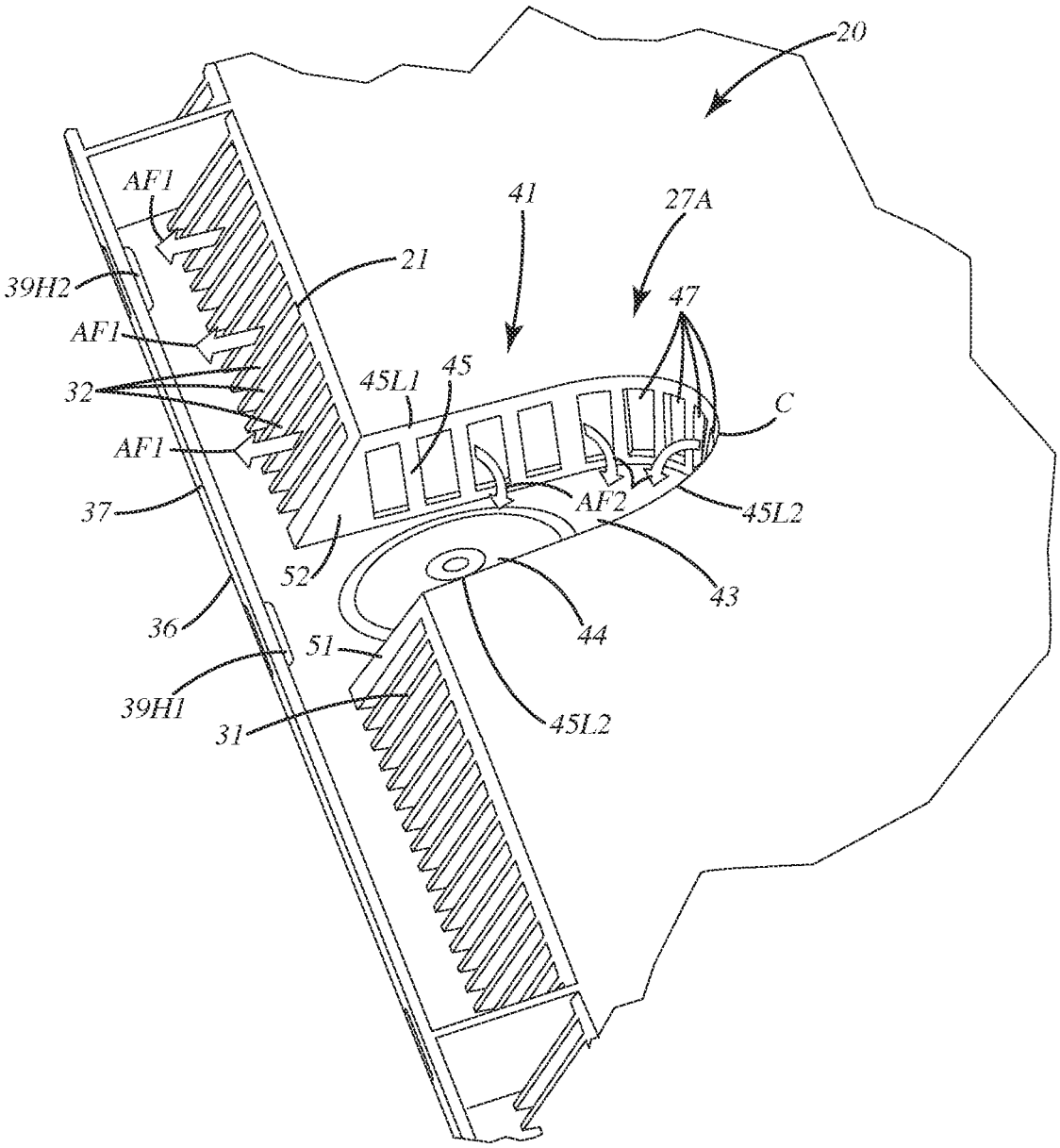
FIG. 3 is a close up perspective view of the fastener recess and flange illustrating multiple recess slots and sidewall slots that are contiguous with one another.
Figure 4:
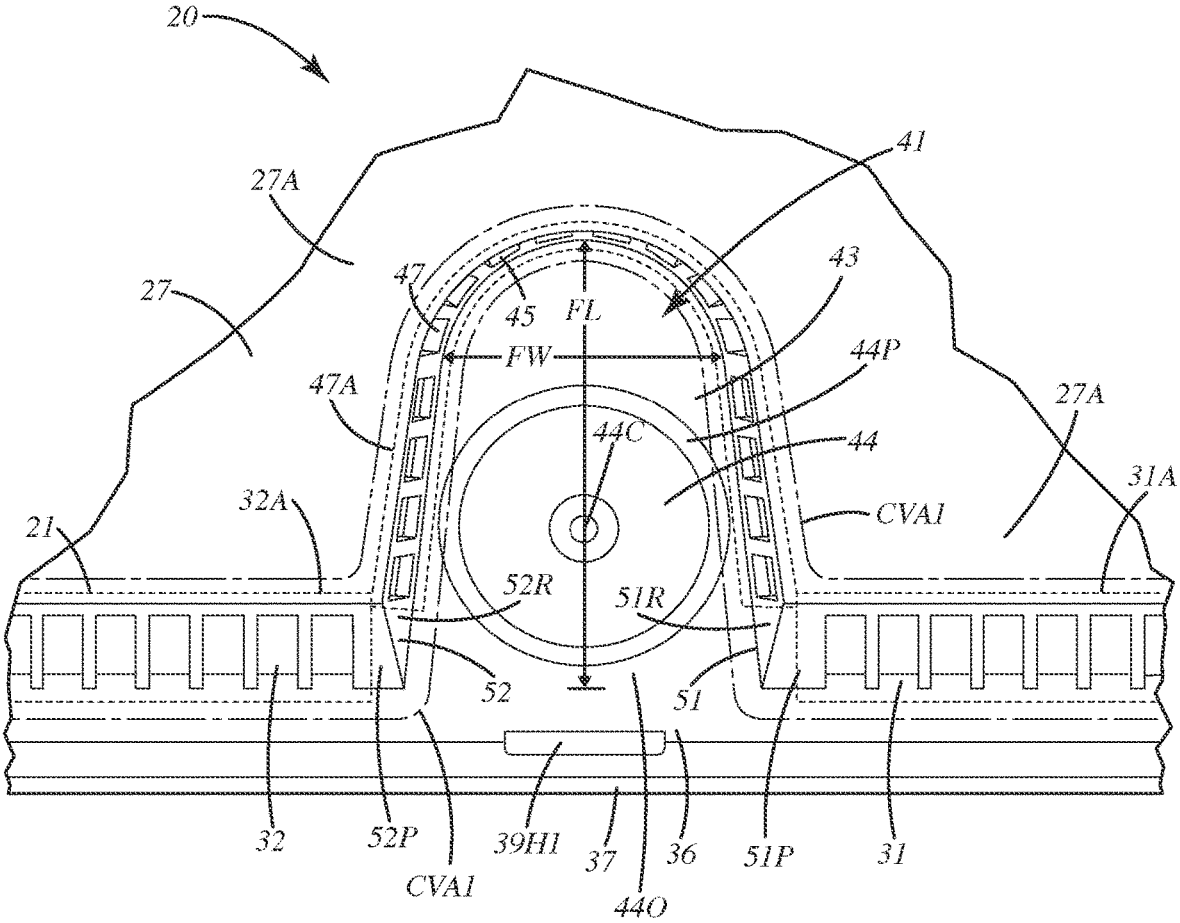
FIG. 4 is a top close up view of the fastener recess illustrating the contiguous vented area along one side of the ridge vent.
Figure 5:
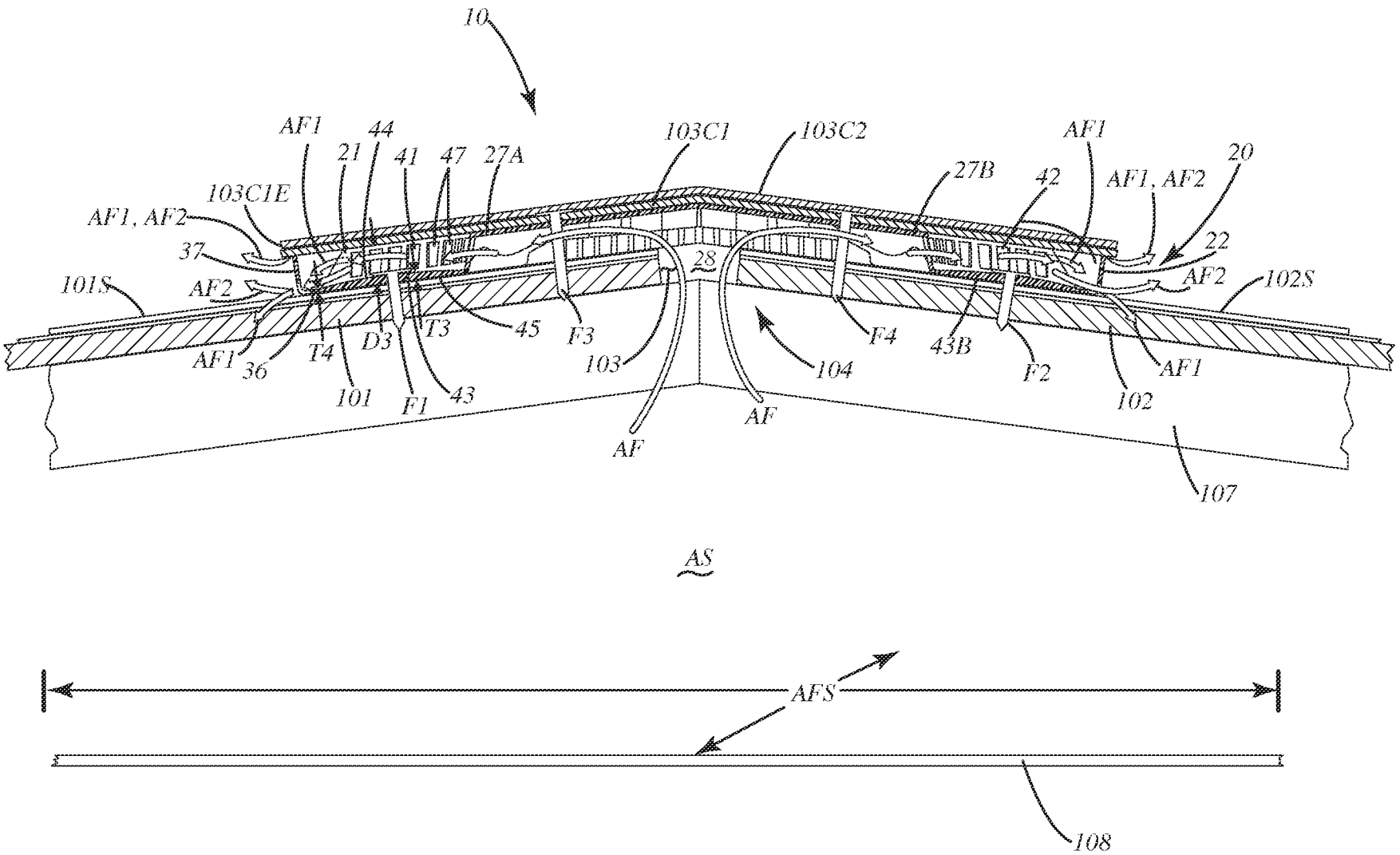
FIG. 5 is a partial section view of the ridge vent in a system where the ridge vent is secured to first and second roof surfaces of a building with fasteners, over an attic space, with shingles further fastened over the ridge vent with fasteners.
Figure 6:
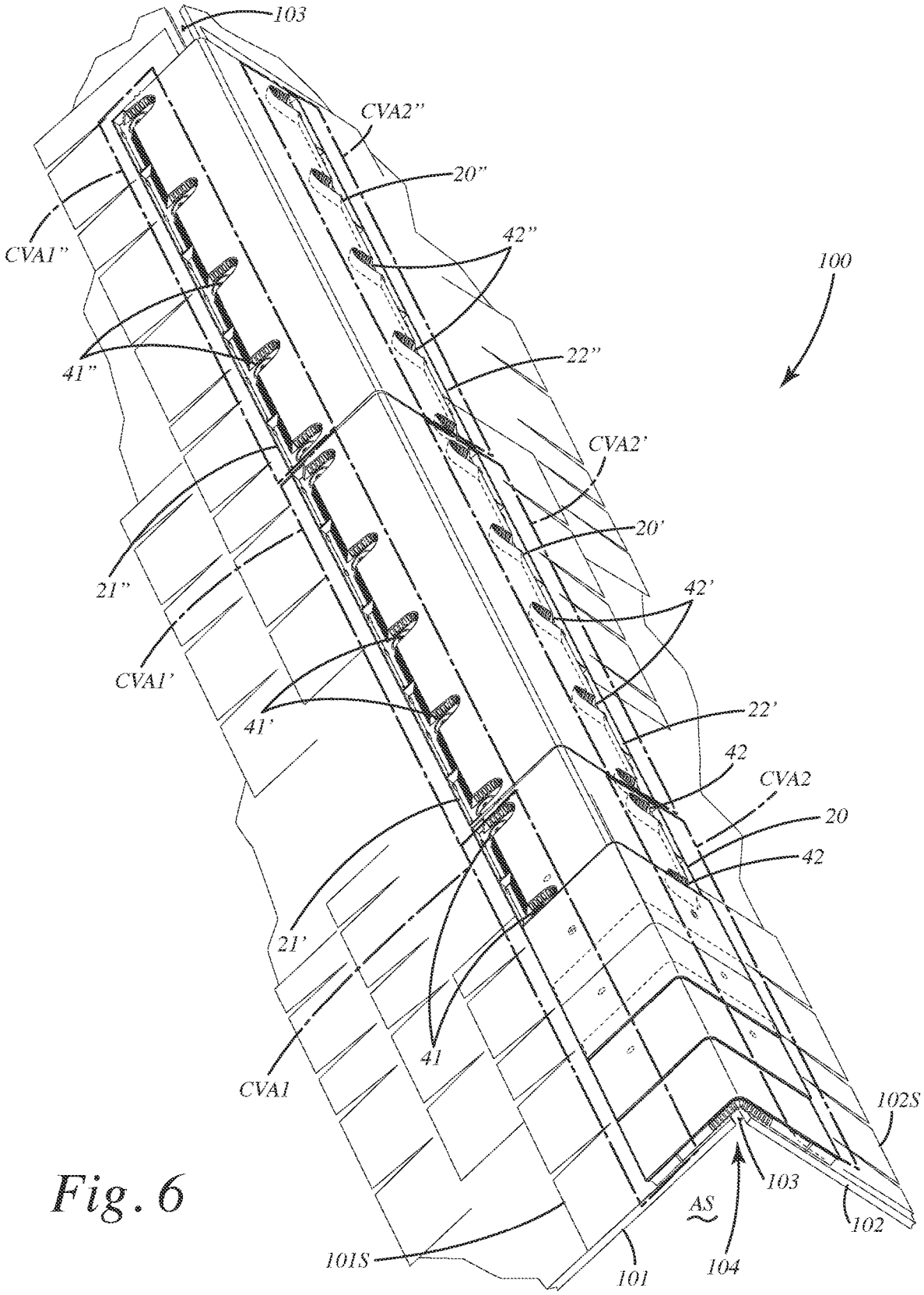
FIG. 6 is a perspective view of multiple ridge vents of a system over a roof, covering an elongated opening at a peak of the roof of the building.

A current embodiment of the ridge vent system and roof vent is shown in FIGS. 1-6 and generally designated 10 and 20, respectively. The ridge vent 10 can be installed on a building 100, generally over an elongated opening 103 defined at the peak 104 where a first roof surface 101 meets a second roof surface 10, as shown in FIGS. 5 and 6. The roof surfaces can be covered with shingles 101S, 102S and an underlayment for waterproofing or other surfaces. The roof surfaces 101 and 102 can be sheets, boards or panels, constructed from wood, metal, plastic, composites or other structural materials. Immediately under the roof surfaces can be a support structure 107 that supports the roof surfaces. Below that can be an attic floor 108, which can be an actual floor or a portion of a ceiling of a room, or a space under the floor 108. An attic floor space AFS can be defined at the floor 108, generally located below the support structure 107, which can be in the form or rafters, trusses or other elements. An attic space or volume AS can be defined below the roof surfaces 101, 102 and the attic floor. Of course, in some applications, the attic space and the attic floor can be absent, with the roof surface simply covering a room or volume in the building.

Generally, the ridge vent system, with the ridge vent 10 installed on the roof surfaces over the opening 103 allows airflow AF to traverse from the attic space AS, along multiple pathways through the ridge vent 10. For example, as shown, the initial airflow AF from the attic space AS can be ventilated out the opening 103 through the ridge vent 20 and out corresponding airflow pathways AF1 and AF2. The airflow pathways AF1 can be associated with multiple sidewall venting slots 31, 32 defined along the exterior sidewalls of the ridge vent 20, while the airflow pathways AF2 can be associated with multiple venting slots 47 defined in each of the fastener recesses 41, 42, also referred to as nailing flange recesses herein. With this system of multiple airflow pathways through multiple different slots along the sidewalls and the fastener recesses of the ridge vents, airflow ventilated out from the attic space can be maximized. In turn, this can prevent moisture and heat build-up inside the attic space AS. In some cases, the ridge vent system 10 can be designed so that multiple ridge vents 20, 20', 20" as shown in FIG. 6, are included in the ridge vent system 10. These ridge vents provide multiple airflow paths AF1 and AF2, through the exterior sidewall slots of the ridge vents as well as the fastener recess venting slots, which cooperatively form contiguous vented areas as described below. The additive effect of these contiguous vented areas can provide an attic ventilation area which allows the ridge vent system to provide ventilation at a minimum of at least 1 square foot of attic ventilation area for every 300 square feet of attic floor space AFS. This ventilation can correspond to and meet the requirements mandated by the U.S. Federal Housing Administration.

Turning now to FIGS. 1-4, the ridge vent 20 will be described in more detail. In particular, with reference to FIG. 1, the ridge vent can include a body 23 having a longitudinal axis LA and a width W. The body 23 can include a first end 25 and a distal second end 26 along with a first side S1 and a second side S2 on opposite sides of the longitudinal axis LA. The body itself can include a top plate 27 extending from the first side S1 to the second side S2. This template can include a first top plate side 27A and a second top plate side 27B. These first and second top plate sides can be generally planar plates and can be joined across the longitudinal axis LA via a bending region 28. This bending region 28 can be an area of flexibility and/or resilience allowing the bending region to bend, flex or otherwise provide angular and/or other movement between the first top plate side and the second top plate side. As a result, the first top plate side and the second top plate side can move and change angular orientation relative to one another.

Figure 1:
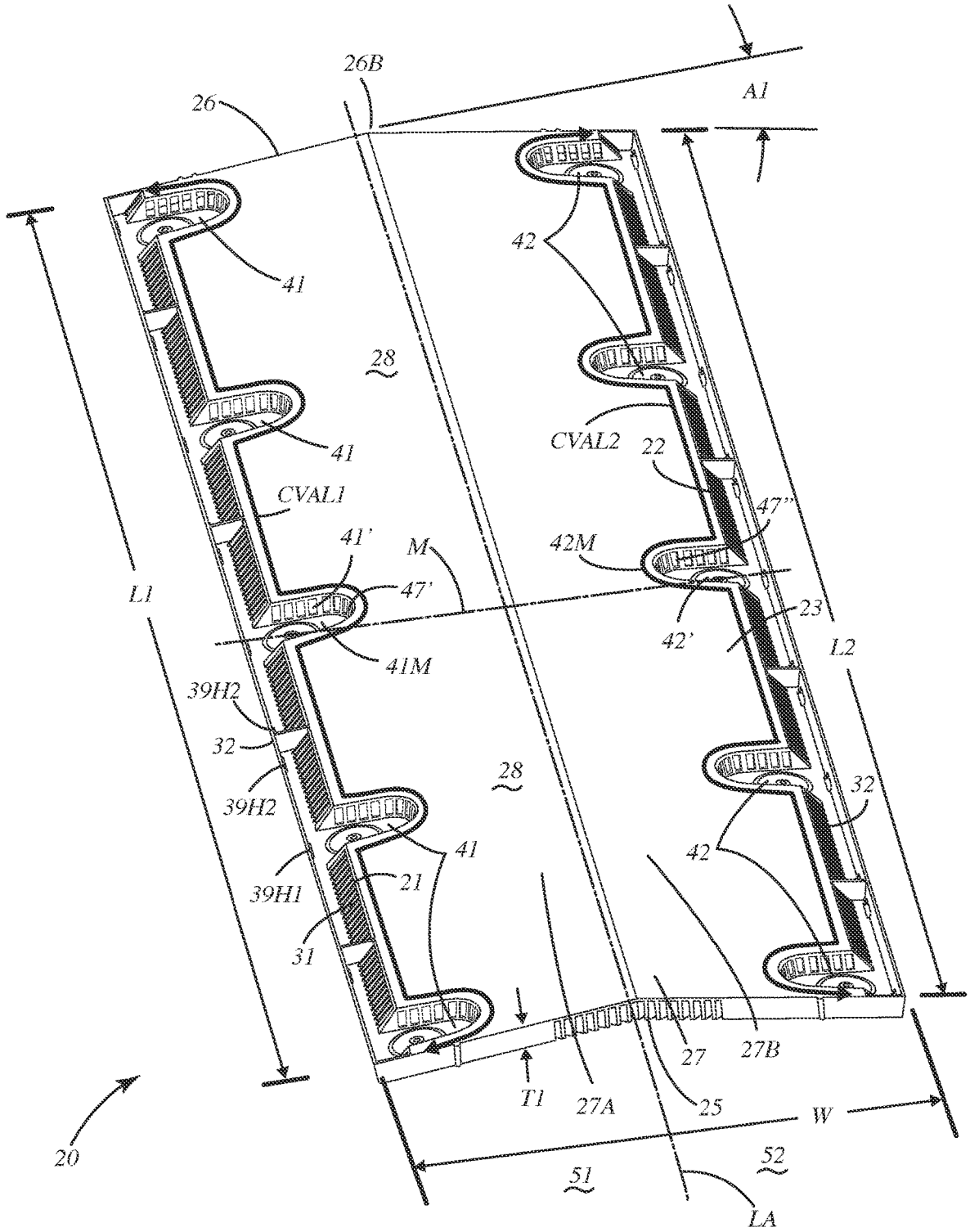
FIG. 1 is a top perspective view of a ridge vent of a current embodiment.
Figure 2:
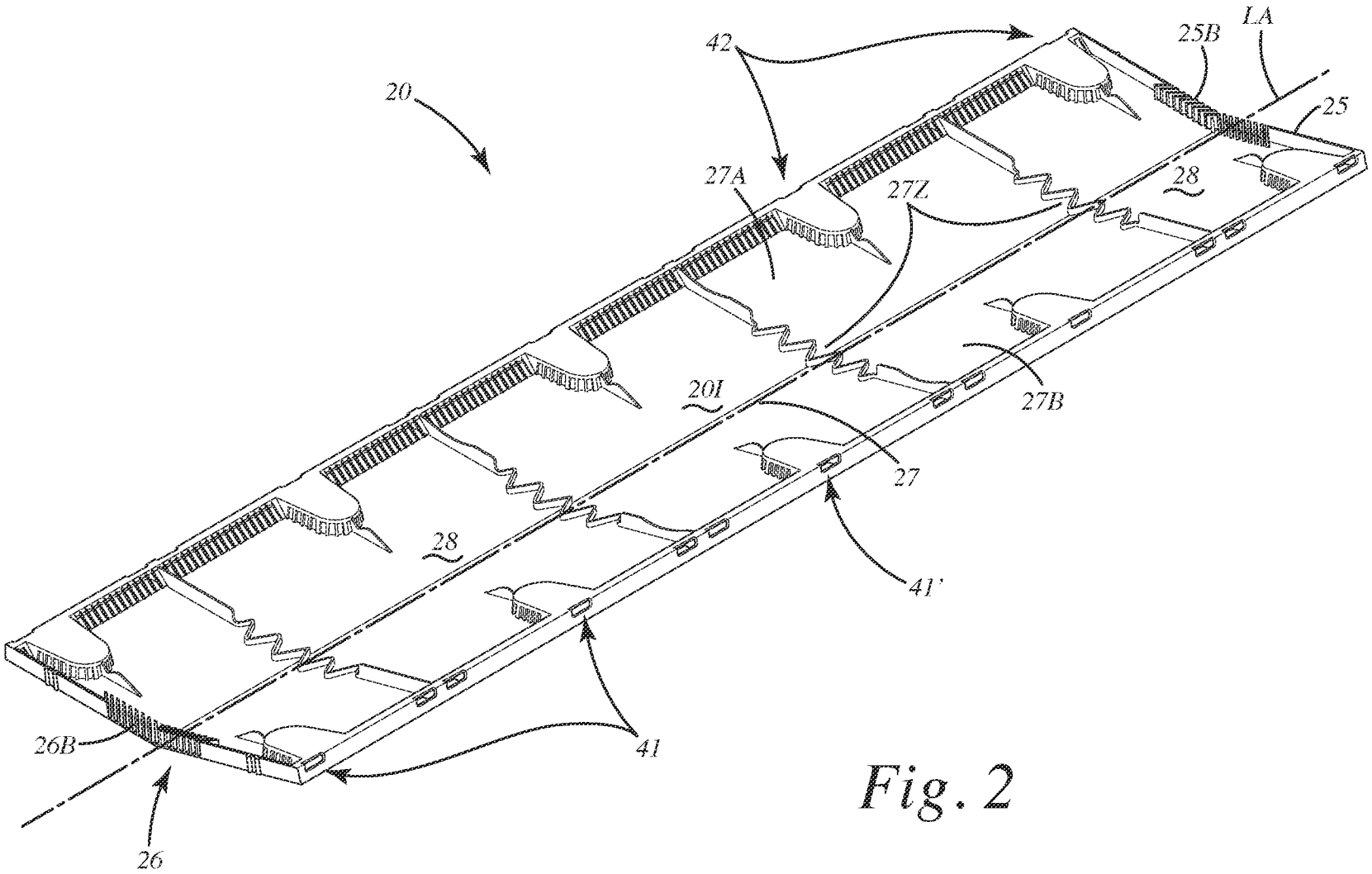
FIG. 2 is a bottom perspective view thereof.

For example, as shown in FIG. 1, the first top plate side 27A can be at a first angle A1 relative to the second top plate side 27B. A user can press or move the first top plate side 27A relative to the second top plate side 27B, in which case the bending region 28 yields, bends or otherwise changes shape to allow that first angle A1 to change to a second angle, which optionally can be a greater angle depending on the slope of the roof surfaces upon which the ridge vent 20 is placed. In some cases, the first end 25 and second end 26 of the body can include bending structures 25B and 26B that facilitate bending of the bending region 28 and the side plates 27A and 27B relative to one another. Optionally, the ridge vent can include a lower side of the top plate 27 as shown in FIG. 2. This lower side can include zigzag walls 27Z that undulate or zigzag back and forth, across the width and transverse to the longitudinal axis, to accommodate and facilitate bending of the top plate 27, and in particular the top plate sides 27A and 27B relative to another.

The top plate shown in FIGS. 1 and 2 can include a first exterior sidewall 21 and a second exterior sidewall 22. The sidewalls can generally be mirror images of one another across the longitudinal axis LA. The sidewall 21 and its features will be described here, noting that the other sidewall 22 can have virtually identical structure and features. The first exterior sidewall 21 can extend downward from the top plate first side 27A. The first exterior sidewall 21 can be angled downward from the top plate, optionally between 15° and 75°, inclusive, or between 1° and 90°, inclusive, as can the second exterior sidewall relative to the second top plate side. The precise angle can be selected so as to reduce the overall thickness T1 of the ridge vent 20 to optionally less than 3 inches, less than 2 inches or less than 1 inch, about 1", about ⅝ inch or about ¾ inch, depending on the application. As a result, with the low profile, the ridge vent can be less likely to be affected by wind and possibly blown off the roof or otherwise damaged in wind.

The first exterior sidewall 21 can define a first plurality of sidewall slots 31 and a second plurality of sidewall slots 32, for example as shown in FIGS. 1 and 3-4. These slots can be polygonal, open slots that lead from an interior 20I of the ridge vent 20 out to the exterior of the ridge vent and into the environment. The slots can be of varying shapes, such as circular, elliptical triangular or other shapes. These slots can extend generally from the first top plate side 27A downward to the lip 36 extends away from the first exterior sidewall 31. These sidewall slots also can be opposed to the first end wall 37 that extends upward from the first lip and that is generally nonparallel to the first exterior sidewall 21 and the slots themselves.

With reference to FIGS. 1, 3 and 4, the first exterior sidewall 21 and the first top plate side 27A cooperatively define one or more first fastener recesses 41, also referred to as nailing flange recesses. The recesses 41 can be designed, configured and sized such that a foot of a nail gun, a screw gun and/or a staple gun can fit within the recess to advance a fastener, such as a screw or a nail into a nailing flange or bottom wall 43 of the recess 41, and optionally through a target region 44 that is disposed on the flange or bottom wall 43. The bottom wall can include a flange length FL and a flange width FW. The length FL can be optionally at least 1.5 times or at least 2.0 times the width FW in some applications to provide adequate clearance for the head or nose of the tool driving the fastener.

Optionally, in some applications, the target region 44 can be disposed inward toward the longitudinal axis LA relative to an outer portion 44O of the nailing flange or bottom wall 43. This target region as shown can be of a circular shape, but in other applications, can be of a polygonal, rounded, or other shape. The target region also can extend a majority or all of the length FL and a majority or all of the width FW of the nailing flange or bottom wall. The target region 44 can be of a thickness T3 (FIG. 5) from the upper surface of the same to a lower surface thereof that is greater than a thickness T4 from the upper surface to the lower surface of the adjacent outer portion 44O of the nailing flange. The outer portion can extend a minority of the length FL, and can be of lesser area than the target region. In some cases, the target region can be optionally at least 5%, at least 10%, at least 15%, at least 20%, at least 25%, at least 50%, at least 75%, or at least 100% thicker than the adjacent outer portion. With this added thickness, the target region can withstand the impact and penetration of a fastener therethrough suitably. The target region optionally can be of a dome shape, of varying thickness from the center 44C to the perimeter 44P, optionally decreasing in thickness outward to the perimeter. In some applications, the perimeter 44P can serve as an indicia element to guide a user where to aim a fastener shot from a nail gun. For this purpose, the perimeter 44P can include a raised surface, such as a ridge or other projection, or a recessed surface, such as a groove or recess, or combinations of the foregoing so that a user can visually identify the target region and its extend to aim the fastener within it.

The first flange or recess again can extend inwardly from the first exterior sidewall 21 and downward from the first top plate side 27A. The first recess can be bounded by the bottom wall or flange 43 as noted above, as well as a recess wall 45. This recess wall 45 can define the third plurality of slots 47 between the bottom wall 43 and the first top plate side 27A. These slots 47 can be similar to the first plurality of slots and second plurality of slots 31 and 32 as described above.

The first recess wall 45 can be constructed as a U-, V- or parabolic shape and can open away from the longitudinal axis LA of the ridge vent 20. The recess sidewall 45 can include a first linear part 45L1 that extends toward the longitudinal axis LA of the ridge vent. This first linear part 45L1 can transition to a curved part 45C that transitions to a second linear part 45L2. The second linear part 45L2 can extend back toward the exterior sidewall 21. Generally, the first linear part 45L1 and second linear part 45L2 can be parallel or nonparallel, being angled relative to one another.

With reference to FIGS. 3-4, the nailing flange recesses 41 can be reinforced with and/or otherwise include first 51 and second 52 transition corners or transitions. The first transition corner can be disposed between the first plurality of slots 31 and the third plurality of slots 47. The transition corner can include a portion 51P of the first exterior sidewall 21 that is solid, without any slots, to buttress the top plate side 27A above the first plurality of slots 31 and the third plurality of slots 47. A portion 51R of the recess wall 45 also can be solid and void of any ports. This can join the portion 51P of the exterior sidewall 21. These portions of the respective walls can cooperate to enhance the strength and support of the top plate side 27A. As mentioned, the second transition corner 52P can be disposed between the second plurality of slots 32 and the third plurality of slots 47 in the recess 41. The second transition corner 52 can include respective portions 52B and 52R of the exterior sidewall and the recess wall, similar to those of the first transition corner 51 as described above.

As shown in FIGS. 3-4, the third plurality of slots 47 for each of the respective nailing flange recesses 41 can be disposed between corresponding ventilation sidewall slots along the exterior sidewall 21. As an example, the third plurality of slots 47 can be located between the first plurality of sidewall slots 31 and the second plurality of sidewall slots 32, respectively. The first plurality of slots 31 can form a first vented area 31A along the sidewall 21. The second plurality of slots 32 can form a second vented area 32A along the first sidewall 21. The third plurality of slots 47 can form a third vented area 47A along the recess wall 45 of the nailing flange recess 41. These three sets of slots 31, 32 and 47 and their respective vented areas 31A, 32A and 47A can cooperatively provide a first contiguous vented area CVA1 along the first exterior sidewall 21 and the first recess wall 45. This contiguous vented area CVA1 can extend along the entire sidewall and into each of the respective nailing flange recesses 41 along the first side S1. In this manner, the venting does not extend merely along the exterior sidewall, but also juts into and is provided within and around the nailing flange recesses 41. It will be appreciated that a similar construction and function for the venting be provided with regard to the second nailing flange recesses 42 that extend into and are defined along the second exterior sidewall 22 with the second top plate side 27B. Of course, a second contiguous vented area CVA2 can be defined along the second exterior sidewall 22 and the second recess walls of each of the respective second nailing flange recesses 42 along that second exterior sidewall 22.

Optionally, the first and second exterior side walls 21 and 22 can define lengths L1 and L2 respectively. The venting areas provided on each of the first side S1 and second side S2 of the ridge vent 20, however are not limited to these linear lengths alone. For example, the first contiguous venting area CVA1 along the first exterior sidewall 21 and the respective recesses 41 can have a first venting area length CVAL1. Likewise, the second continuous venting area CVA2 along the second exterior sidewall 22 and the respective recesses 42 can have a second venting area length CVAL2. The first venting area length CVAL1 can be greater than the first wall length L1. The second venting area length CVAL2 also can be greater than the second wall length L2. In some cases, the venting area lengths can be greater than the respective wall length optionally, at least 2% greater, at least 5% greater, at least 10% greater, at least 20% greater, or at least 25% greater than then the respective wall length. With the inclusion of the slots in the nailing flange recesses and along the exterior sidewall, this in turn can increase ventilation airflow through the ridge vent significantly over instances where the nailing flange recesses do not include corresponding recess slots.

As mentioned above, the ridge vent 20 can have multiple first nailing flange recesses 41 and second nailing flange recesses 42 disposed and formed adjacent the respective first exterior sidewall 21 and second exterior sidewall 22. As shown, there are five nailing flanged recesses 41 disposed across from one another or another across the longitudinal axis LA on each of the respective sides S1 and S2. Optionally, nailing flange recesses 41M and 42M can be disposed across from one another at the midline M of the lengths L1 and L2 of the sidewalls. With this construction, the nailing flanges can securely hold down the ridge vent, optionally in the center of the length of the vent, and prevent or impair it from buckling under expansion and contraction during exposure to different temperatures and environments.

As mentioned above, there can be any number of the various first and second recesses 41, 42 along the respective sidewalls. For example, the first exterior sidewall 21 and the first top plate side 27A can cooperatively define a third recess 41' that extends inwardly from the first exterior sidewall and downward from the first top plate side, distal from another first recess 41 along the first exterior sidewall. The third recess 41' can be bounded by a third bottom wall and a third recess wall extending from the third bottom wall to the first top plate side. The third recess wall can define a seventh plurality of slots 47' between the third bottom wall and the first top plate side. The seventh plurality of slots 47' can cooperate with the first, second and third plurality of slots to provide the first contiguous vented area CVA1 along the first exterior sidewall 21, the first recess wall and the third recess wall. The second exterior sidewall 22 and the second top plate side 27B can cooperatively define a fourth recess 42' that extends inwardly from the second exterior sidewall 22 and downward from the second top plate side 27B. The fourth recess 42' can be bounded by a fourth bottom wall and a fourth recess wall extending from the fourth bottom wall to the second top plate side. The fourth recess wall can define an eighth plurality of slots 47" between the fourth bottom wall and the second top plate side. The eighth plurality of slots 47" can cooperate with the fourth, fifth and sixth plurality of slots along the second exterior sidewall to provide the second contiguous vented area CVA2 along the second exterior sidewall, the second recess wall and the fourth recess wall.

As mentioned above, with reference to FIGS. 3-4, the first end wall 37 can be joined with the first lip 36 that extends outward from the first exterior sidewall 21. One or more drain holes 39H1, 39H2 can be defined intermittently along the first end wall and/or the first lip along the first side S1 and across from the respective first exterior sidewall 21. These drain holes can be sized such that rain, snow, moisture and other liquids can drain out the holes 39H1 and 39H2, rather than entering primarily back through the slots 31, 32 and or 45 of the respective sidewall and/or nailing flange recess. In some cases, each drain hole 39H1 can be disposed immediately in front of a respective nailing flange recess 41, optionally centered on that nailing flange recess. Additional drain holes 39H2 can be disposed distal and/or between respective ones of the nailing flange recesses 41. These second drain holes 39H2 can be disposed across from the first and second plurality of sidewall slots depending on the application. The first drain holes 39H1 can be disposed across from and face the recess plurality of recess slots 47. Corresponding drain holes can be disposed along the second side S2, similarly situated relative to the corresponding second lip and second end wall across from the second exterior sidewall 22.

The ridge vent 20 can be included in a ridge vent system 10. With reference to FIGS. 5-6, the overall system will be described in more detail. There, the ridge vent 20 is shown applied with additional ridge vents 20' and 20" all of which generally cover elongated opening 103 along a ridge line of two adjacent first roof surface 101 and second roof surface 102. Each of these additional ridge vents can have multiple third and fourth nailing flange recesses 41', 41", 42', 42" with associated recess slots and sidewall slots, defined in their respective first exterior side walls 21', 21" and second exterior sidewalls 22', 22". The respective slots of the sidewalls and nailing flange recesses form respective contiguous venting areas CVA1' and CVA2', and CVA1" and CVA2". When added up, the first contiguous vented area CVA1 plus the second contiguous vented area CVA2, plus each third contiguous vented area CVA1' and CVA2', plus each fourth contiguous vented area CVA1", CVA2" equals an attic ventilation area. Airflow AF from the attic space AS escapes out through the elongated opening 103 along the air paths AF1 and AF2 (FIGS. 5 and 6) on both sides of each respective ridge vent to ventilate the attic space AS. Optionally, the ridge vent system including the ridge vents, which can vary based on the application, provide ventilation at a minimum of at least 1 square foot of attic ventilation area for every 300 square feet of attic floor space AFS.

Each of the respective ridge vents 20, 20' and 20" can be secured to the roof surfaces 101 and 102 via multiple fasteners. For example, multiple first fasteners F1 can be installed and advanced to project through or pierce each of the respective first bottom walls or nailing flanges 43 of each respective recess 41 on the first sides of the ridge vents. These fasteners can extend into the first roof surface 101 and optionally through it, and into an underlying support structure 107 or simply to the attic space. This can secure the first top plate side 27A and generally the ridge vent to the roof first roof surface 101. Multiple second fasteners F2 can be installed and advanced to project through or pierce each of the respective second bottom walls or nailing flanges 43B in the second sides of the ridge vents, as well as the second top plate side 27B, to the second roof surface 102. When this occurs, each of the ridge vents optionally can bend in the bending region 28 to finally conform to the angle of the first and second roof surfaces 101, 102 which can be nonparallel to one another. In this manner, the fasteners F1 and F2 can maintain the first top plate side 27A the second top plate side 27B in a nonparallel configuration relative to one another.

Optionally, the ridge vent 20 can be placed over shingles 101S and 102S that are disposed over underlayment and generally over the roof surfaces 101 and 102 respectively. When this occurs, the first fasteners F1 and second fasteners F2 can pierce through the first shingles 101S and second shingles 102S on opposing sides of the elongated opening 103.

The system 10 also can include a plurality of cover shingles 103C1 and 103C2 that are disposed over the top plate, optionally stacked one over the other in a partially overlapping configuration. The shingle 103C1 can extend over and cover the first plurality of recesses 41 and the first side of the ridge vent, as well as the second plurality of recesses 42 on the second side of the ridge vent. The shingles can extend outwardly to the respective first and second exterior sidewalls of the ridge vent, optionally covering the lip 36 or end wall 37 on the respective first and second sides of the ridge vent. In this manner, a space is left between the end wall 37 and the ends 103C1E of the shingles that are disposed over the top plate. In this manner, airflow can flow along the pathways AF1 and AF2 out between those elements. Further, there can be minute vertical gaps between the ends of the shingles and the lip 36 or end wall 37 of the ridge vent, so the airflow AF1 and AF2 can escape through these gaps and or the drain holes. In some cases, the ends of the shingles can move upward under the force of the air and slightly move so the airflow AF1 and AF2 can escape from the vent and into the environment.

The shingle 103C1 also can form a roof over each one of the respective nailing flange recesses 41 and 42, however airflow can still travel in each of the respective recesses out of the recess walls 45 and in particular the respective recess walls slots 47 of each of the respective recesses on both sides of the ridge vent.

The shingles can extend outwardly over each of the respective first fasteners F1 and second fasteners F2 and the respective first recesses 41 and second recesses 42. The shingles however, can be separated from the heads of the respective fasteners by distance D3 that is greater than a diameter of a head of the first and second fasteners. Is also noted that the airflow along the airflow path AF2 also moves over the respective heads of the fasteners F1 and F2 located within the respective nailing flange recesses.

The shingles can be fastened down to the ridge vent and the underlying surfaces via third F3 and fourth F4 fasteners. The third and fourth fasteners can project, pierce or penetrate the shingle 103C1 as well as the first top plate side 27A and the second top plate side 27B as well as the top plate in general. In particular, the third fastener F3 can project through the first top plate side 27A and into the first roof surface 101 as well as through the shingles 101S and any underlayment. This third fastener F3 however is distal from the first recesses 41 and is not disposed in those recesses. Indeed, the third fastener F3 can be disposed between the first recess 41 and the bending region 28. In some cases, the third fasteners F3 can be disposed between adjacent ones of the first recesses 41 and closer to the first exterior sidewall 21. The fourth fastener F4 can project through the second top plate side 27B and into the second roof surface 102 as well as through the shingles 102S and any underlayment. The fourth fasteners however can be distal from the second recesses 42 and not disposed in or enter those recesses. Indeed, the fourth fasteners F4 can be disposed between the second recesses 42 and the bending region 28. In some cases, the fourth fasteners F4 can be disposed between adjacent ones of the second flange recesses 42 and closer to the exterior sidewall 22. These third and fourth fasteners can be covered subsequently by another shingle 103C2 that is laid over the shingle 103C1. That shingle can partially overlap the first shingle 103C1, and can be further nailed with additional third and fourth fasteners securing it to the ridge vent and the underlying roof surfaces. Multiple shingles can be laid over the various adjacent ridge vents disposed along the peak to provide an aesthetically pleasing cover over that ridge vent to conceal the nailing flange recesses along the ridge vents.

Figure 7:
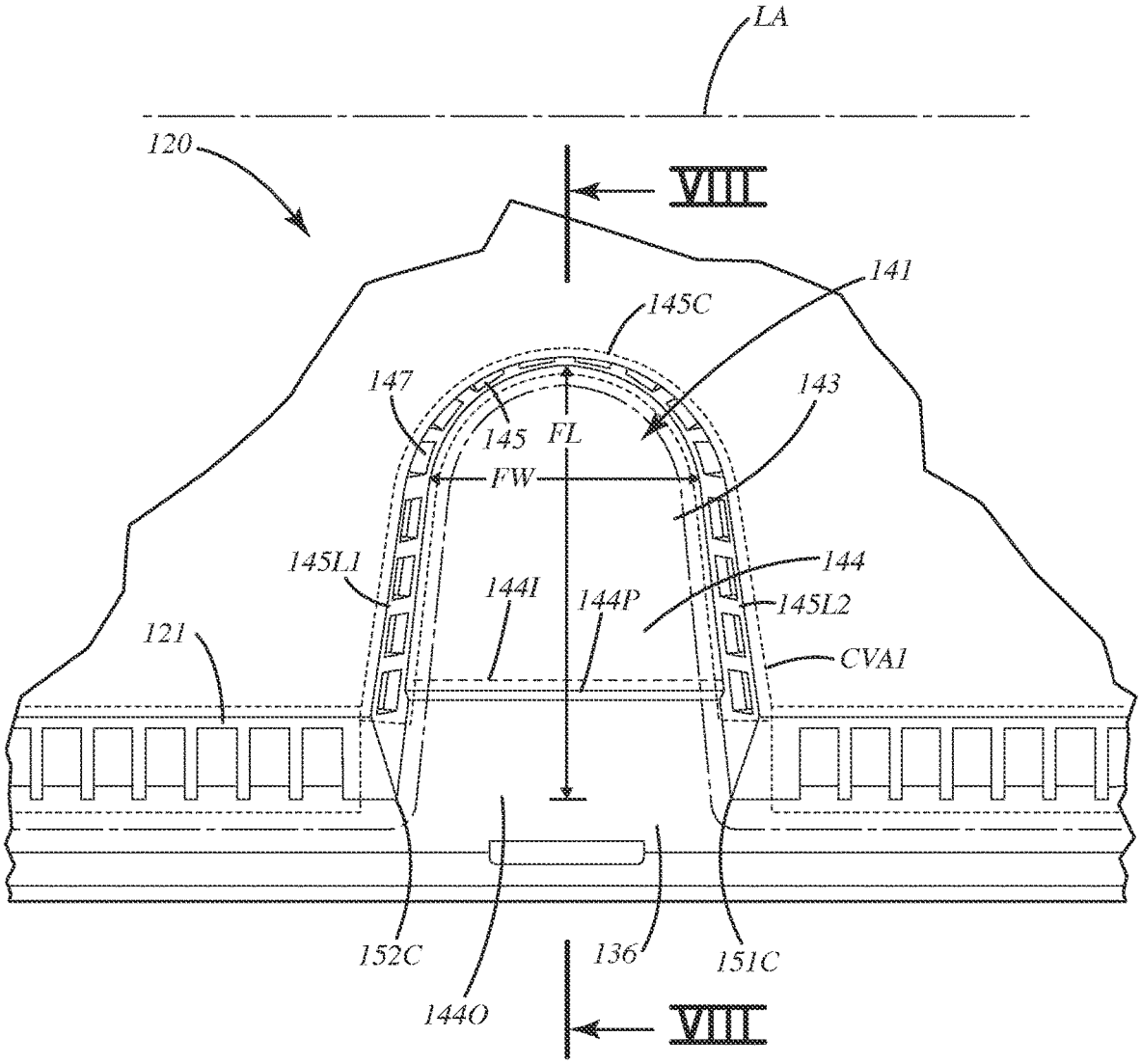
FIG. 7 is a top close up view of a ridge vent of an alternative embodiment having a thickened target region in a nailing flange.
Figure 8:
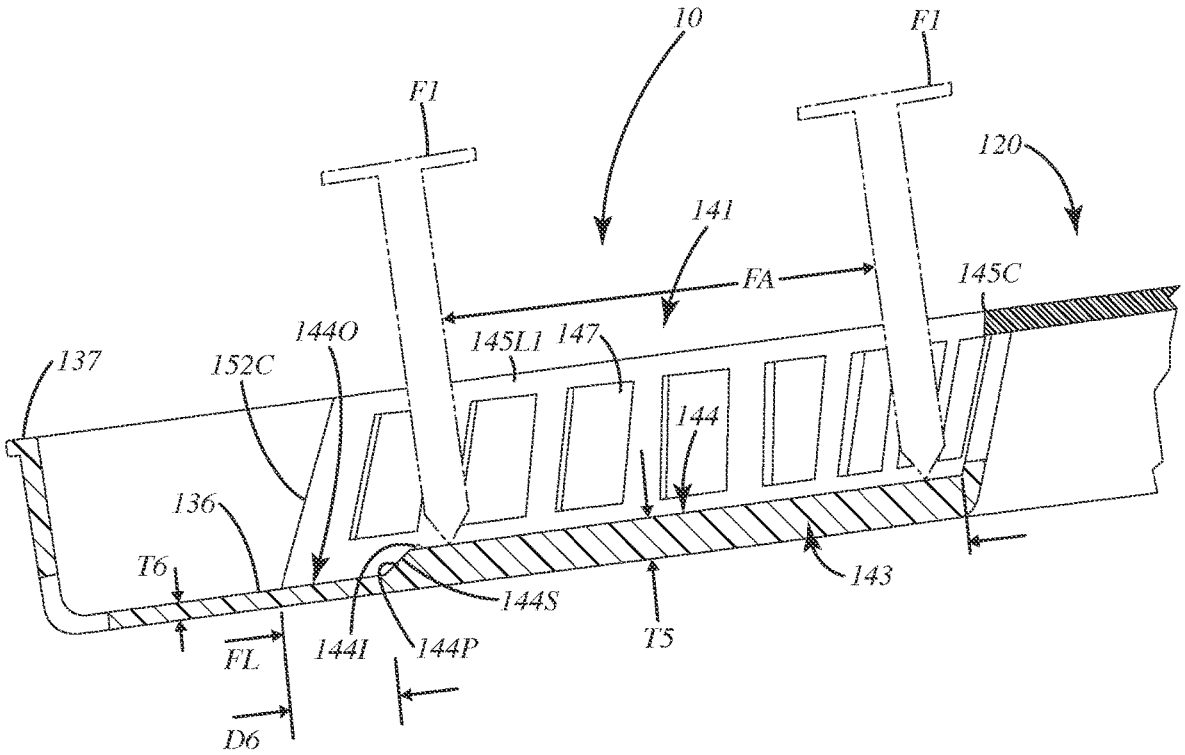
FIG. 8 is a section view thereof.

A second alternative embodiment of the ridge vent is illustrated in FIGS. 7-8 and generally designated 120. This embodiment is virtually identical in structure, function and operation to the embodiment of the ridge vent 20 described above with several exceptions. For example, in this embodiment, the ridge vent 120 can include a first flange or recess 141 extending inwardly from the first exterior sidewall 121 and downward from the top plate. The recess 141 can be designed, configured and sized such that a foot of a nail gun, a screw gun and/or a staple gun can fit within the recess to advance a fastener, such as a screw or a nail into a nailing flange thereof. Optically, the first recess 141 can be bounded by the flange, bottom wall or floor 143 as noted in the embodiment above, as well as a recess wall 145 which can be separated into different portions such as linear portions 145L1 and 145L2, as well as curved portion 145C, or other permutations or combinations thereof. This recess wall 145 can define the slots 147 between the bottom wall 143 and the top plate. These slots 147 can be similar to the slots in the nailing recess of the embodiment as described above.

In this embodiment however, the ridge vent 120 can include one or more nailing flanges or recesses 141 that can include a bottom wall or floor 143 with enhanced strength to withstand the impact force of a fastener driven therethrough with a nailing gun or other fastener driver. As shown in FIG. 7, the bottom wall can include a flange length FL and a flange width FW. The length FL can be optionally at least 1.5 times or at least 2.0 times the width FW like the embodiment above. The bottom wall also can include a target region 144 disposed inward toward the longitudinal axis LA relative to an outer portion 144O of the nailing flange or bottom wall 143. This target region 144 also can be in disposed inwardly, toward the longitudinal axis LA, from the corners 151C and 152C, where the sidewall 121 meets the walls of the nailing recess or flange 141. As shown in FIG. 8, the target region 144 can be disposed inwardly a distance D6 from the respective corners. The target region 144 can span from one side of the recess across the width FW. It also can span as mentioned above a majority of the length FL of the recess 141 extending outwardly from and perpendicular to the longitudinal axis LA. The target region 144 can extend entirely across the bottom of the 143 of the recess 141 up to the perimeter 144P of the target region. This perimeter 144P can be delimited by a gradual or abrupt step 144S that transitions downward to the remaining portion or outer portion 144O of the floor 143 of the recess 141. That outer portion 144O can transition flush to the lip 136 which transitions to the outer wall 137.

The target region 144 optionally can extend a majority or all of the length FL and a majority or all of the width FW of the nailing flange or bottom wall. The outer portion 144O can extend a minority of the length FL, and can be of lesser area than the target region. The target region 144 can be of a thickness T5 from the upper surface of the same to a lower surface thereof that is greater than a thickness T6 from the upper surface to the lower surface of the adjacent outer portion 144O of the nailing flange recess 141. In some cases, the target region can be optionally at least 5%, at least 10%, at least 15%, at least 20%, at least 25%, at least 50%, at least 75%, or at least 100% thicker than the adjacent outer portion. With this added thickness, the target region can withstand the impact and penetration of a fastener therethrough suitably.

In some applications, the perimeter 144P can serve as an indicia to guide a user where to aim a fastener shot from a nail gun. In some cases, the perimeter 144P can include a dedicated indicia element 144I, which can be a raised surface, such as a ridge, step, transition, or other projection, or a recessed surface, such as a groove or recess, or combinations of the foregoing so that a user can visually identify the target region and its extend to aim the fastener within it. In some cases, the indicia element can be configured or displayed as a dotted or broken line adjacent or over the perimeter 144P or close to it and can include alphanumeric characters to indicate where the target region 144 begins and ends. With this indicia element or the perimeter being visible, a user can readily identify the fastener area FA within which it is suitable to advance a fastener F1 into the bottom of the nailing recess 141 and particularly and precisely penetrate through the bottom wall 143 within the target region 144. Again, where the target region 144 is thicker, it can withstand the forces due to the penetration of the fastener F1 therethrough, in some cases better than the remaining outer portion 144O of the recess. This can preserve the integrity of the nailing recess and the bottom wall 143 provide for a stronger and more efficient securement of the ridge vent 122 an underlying substrate.

The following additional Statements illustrate further embodiments, the numbering of which is not to be construed as designating levels of importance. Moreover, it is to be understood that the Statements of embodiments recited below are provided in conjunction with and in addition to the embodiments described above, as well as those claimed even farther below. Alternative embodiments that result from combining, integrating, and/or omitting features of the embodiments of the Statements below or any other embodiment described herein may also be within the scope of the present invention.

Statement A: A ridge vent for a roof of a building, the ridge vent comprising: a body including a first end, a second end opposite the first end, a first side, a second side opposite the first side, and a longitudinal axis; a top plate extending from the first side toward the second side and including first top plate side, a second top plate side and a bending region between the first top plate side and the second top plate side, the bending region overlapping the longitudinal axis and configured so that the first top plate side and the second top plate side can move and change an angular orientation relative to one another; a first exterior sidewall extending downward from the top plate on the first side, the first exterior sidewall being angled downward from the top plate, the first exterior sidewall defining a first plurality of slots and a second plurality of slots, the first exterior sidewall and the first top plate side cooperatively defining a first recess that extends inwardly from the first exterior sidewall and downward from the first top plate side, the first recess being bounded by a first bottom wall and a first recess wall extending from the first bottom wall to the first top plate side, the first recess wall defining a third plurality of slots between the first bottom wall and the first top plate side, the third plurality of slots being located between the first plurality of slots and the second plurality of slots to provide a first contiguous vented area along the first exterior sidewall and the first recess wall, the first recess wall extending along a curved path inward from the first exterior sidewall, with the third plurality of slots following the curved path to provide a first venting area around the first recess that is curvilinear.

Statement B: The ridge vent of Statement A comprising a first target region in the first recess delimited by an indicia element whereby a user can identify a location in the first target region to install a fastener through the first target region.

Statement C: The ridge vent of any preceding Statement wherein the first, second and third plurality of slots form the first contiguous vented area that has a first venting length longer than a length of the body taken along the longitudinal axis.

Statement D: The ridge vent of any preceding Statement wherein the first recess wall includes a curvilinear portion nearest the longitudinal axis that transitions to first and second linear portions nearest the first sidewall.

Statement E: The ridge vent of any preceding Statement wherein the first target region spans a width between the first and second linear portions across the first floor.

Statement F: The ridge vent of any preceding Statement wherein the first target region includes a dome shape of a first thickness greater than a second thickness of a first remaining portion.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A ridge vent for a roof of a building, the ridge vent comprising:

a body including a first end, a second end opposite the first end, a first side, a second side opposite the first side, and a longitudinal axis;

a top plate extending from the first side toward the second side and including a first top plate side, a second top plate side and a bending region between the first top plate side and the second top plate side, the bending region overlapping the longitudinal axis and configured so that the first top plate side and the second top plate side can move and change an angular orientation relative to one another;

a first exterior sidewall extending downward from the top plate on the first side, the first exterior sidewall being angled downward from the top plate, the first exterior sidewall defining a first plurality of slots and a second plurality of slots, the first exterior sidewall and the first top plate side cooperatively defining a first recess that extends inwardly from the first exterior sidewall and downward from the first top plate side, the first recess being bounded by a first bottom wall and a first recess wall extending from the first bottom wall to the first top plate side, the first recess wall disposed between the longitudinal axis and the first exterior sidewall, the first recess wall being closer to the longitudinal axis than the first exterior sidewall; and a second exterior sidewall extending downward from the top plate on the second side, the second exterior sidewall being angled downward from the top plate, the second exterior sidewall defining a third plurality of slots and a fourth plurality of slots, the second exterior sidewall and the second top plate side cooperatively defining a second recess that extends inwardly from the second exterior sidewall and downward from the second top plate side, the second recess being bounded by a second bottom wall and a second recess wall extending from the second bottom wall to the second top plate side, the second recess wall disposed between the longitudinal axis and the second exterior sidewall, the second recess wall being closer to the longitudinal axis than the second exterior sidewall.

2. The ridge vent of claim 1, wherein the first recess wall includes a first linear part that extends toward the longitudinal axis and transitions to a first curved part that transitions to a second linear part that extends back toward the first exterior sidewall.

3. The ridge vent of claim 1, wherein the first bottom wall includes a length and a width, wherein the length is at least at least 1.5 times the width.

4. The ridge vent of claim 1, wherein the first bottom wall includes an outer portion that extends inwardly away from the first exterior sidewall toward the longitudinal axis, wherein the first bottom wall is bounded by the first recess wall, wherein the outer portion transitions flush to a lip that extends along the first exterior sidewall, farther from the longitudinal axis than the outer portion.

5. The ridge vent of claim 4, wherein the outer portion transitions to a target region along the first bottom wall, wherein the first bottom wall includes a length, wherein the target region extends along a majority of the length, wherein the outer portion extends along less than the majority of the length.

6. The ridge vent of claim 1, wherein the first bottom wall includes an outer portion that transitions to a target region, wherein the first bottom wall includes a length, wherein the target region extends along a majority of the length, wherein the outer portion extends along less than the majority of the length.

7. The ridge vent of claim 6, wherein the target region and the outer portion are delineated by an indicia element that is a raised surface between the target region and the outer portion, whereby a user can identify the target region within the first recess and install a fastener therethrough instead of through the outer portion.

8. The ridge vent of claim 7, wherein the first bottom wall includes a target region having a first thickness, wherein the first bottom wall includes an outer portion adjacent the first bottom wall, but farther from the longitudinal axis than the target region, the outer portion having a second thickness, wherein the first thickness is greater than the second thickness.

9. The ridge vent of claim 7, wherein the target region comprises a perimeter, wherein an indicia element is disposed adjacent the perimeter, whereby a user can identify the target region within the first recess and install a fastener therethrough instead of through the outer portion.

10. The ridge vent of claim 1, wherein the first recess wall is U-shaped and opens away from the longitudinal axis.

11. The ridge vent of claim 1, comprising:

a first lip extending away from the first exterior sidewall; and a first end wall extending upward from the first lip, opposing the first and second plurality of slots, wherein at least one of the first end wall and the first lip define a first plurality of drain holes, the drain holes intermittently disposed along the at least one of the first end wall and the first lip, wherein a first drain hole is disposed in front of the first recess.

12. The ridge vent of claim 1, wherein the first bottom wall includes a first target region and a first remaining portion, and a first perimeter between the first target region and a first remaining portion along the first bottom wall, wherein a first indicia element is along the first perimeter, whereby a user can identify the first target region within the first recess via the first indicia element and install a fastener through the first target region instead of through the first remaining portion.

13. The ridge vent of claim 12, comprising:

a first contiguous vented area, wherein the first exterior sidewall includes a first wall length that extends along the first exterior sidewall and linearly passes by the first recess, wherein the first contiguous vented area includes a first venting area length that extends along the first exterior sidewall and extends around the first recess, wherein the first venting area length is greater than the first wall length.

14. A ridge vent for a roof of a building, the ridge vent comprising:

a body including a first end, a second end opposite the first end, a first side, a second side opposite the first side, and a longitudinal axis;

a top plate extending from the first side toward the second side and including a first top plate side, a second top plate side and a bending region between the first top plate side and the second top plate side, the bending region overlapping the longitudinal axis and configured so that the first top plate side and the second top plate side can move and change an angular orientation relative to one another;

a first exterior sidewall extending downward from the top plate on the first side, the first exterior sidewall being angled downward from the top plate, the first exterior sidewall defining a first plurality of slots and a second plurality of slots, the first exterior sidewall and the first top plate side cooperatively defining a first recess that extends inwardly from the first exterior sidewall and downward from the first top plate side, the first recess being bounded by a first bottom wall and a first recess wall extending from the first bottom wall to the first top plate side, the first recess wall disposed between the longitudinal axis and the first exterior sidewall; and a second exterior sidewall extending downward from the top plate on the second side, the second exterior sidewall being angled downward from the top plate, the second exterior sidewall defining a third plurality of slots and a fourth plurality of slots, the second exterior sidewall and the second top plate side cooperatively defining a second recess that extends inwardly from the second exterior sidewall and downward from the second top plate side, the second recess being bounded by a second bottom wall and a second recess wall extending from the second bottom wall to the second top plate side, the second recess wall disposed between the longitudinal axis and the second exterior sidewall, wherein the first bottom wall includes a first target region and a first remaining portion delineated by a perimeter along the first bottom wall, with a first indicia element adjacent the first target region, wherein a user can identify the first target region within the first recess via the first indicia element and install a fastener through the first target region instead of through the first remaining portion.

15. The ridge vent of claim 14, wherein the first bottom wall includes a length, wherein the first target region extends along a majority of the length, wherein the first remaining portion extends along less than the majority of the length, wherein the first recess wall is U-shaped and opens away from the longitudinal axis.

16. A ridge vent system for a roof of a building, the ridge vent system comprising:

a first ridge vent comprising:

a body including a first end, a second end opposite the first end, a first side, a second side opposite the first side, and a longitudinal axis, the body placed over an elongated opening along a ridge of a roof between a first roof surface and a second roof surface;

a top plate extending from the first side toward the second side and including a first top plate side and a second top plate side on opposite sides of the longitudinal axis;

a first exterior sidewall extending downward from the top plate on the first side, the first exterior sidewall extending downward from the top plate, the first exterior sidewall defining a plurality of first sidewall slots, the first exterior sidewall and the first top plate side cooperatively defining a plurality of first recesses that extend inwardly from the first exterior sidewall toward the longitudinal axis and downward from the first top plate side, each of the plurality of first recesses being bounded by a first bottom wall and a first recess wall extending from the first bottom wall to the first top plate side; and a second exterior sidewall extending downward from the top plate on the second side, the second exterior sidewall extending downward from the top plate, the second exterior sidewall defining a plurality of second sidewall slots, the second exterior sidewall and the second top plate side cooperatively defining a plurality of second recesses that extend inwardly from the second exterior sidewall toward the longitudinal axis and downward from the second top plate side, each of the plurality of second recesses being bounded by a second bottom wall and a second recess wall extending from the second bottom wall to the second top plate side;

a plurality of first fasteners, each projecting through a respective first bottom wall and into the first roof surface to secure the first top plate side to the first roof surface;

a plurality of second fasteners, each projecting through a respective second bottom wall and into the second roof surface to secure the second top plate side to the second roof surface;

a shingle placed over the top plate, the shingle covering at least one of the plurality of first recesses and at least one of the plurality of second recesses on opposite sides of the longitudinal axis;

a third fastener projecting through the shingle, the first top plate side and into the first roof surface to secure the shingle over the top plate, the third fastener distal from the plurality of first recesses; and a fourth fastener projecting through the shingle, the second top plate side and into the second roof surface to secure the shingle over the top plate, the fourth fastener distal from the plurality of second recesses;

wherein the first recess wall defines a plurality of first recess slots between the first bottom wall and the first top plate side, the plurality of first recess slots and the plurality of first sidewall slots cooperatively forming a first contiguous vented area along the first exterior sidewall and the plurality of first recesses so that air can flow out from the elongated opening, under the top plate, and out the first contiguous vented area, wherein the second recess wall defines a plurality of second recess slots between the second bottom wall and the second top plate side, the plurality of second recess slots and the plurality of second sidewall slots cooperatively forming a second contiguous vented area along the second exterior sidewall and the plurality of second recesses so that air can flow out from the elongated opening, under the top plate, and out the second contiguous vented area.

17. A ridge vent system for a roof of a building, the ridge vent system comprising:

a first ridge vent comprising:

a body including a first end, a second end opposite the first end, a first side, a second side opposite the first side, and a longitudinal axis, the body placed over an elongated opening along a ridge of a roof between a first roof surface and a second roof surface;

a top plate extending from the first side toward the second side and including a first top plate side and a second top plate side on opposite sides of the longitudinal axis;

a first exterior sidewall extending downward from the top plate on the first side, the first exterior sidewall extending downward from the top plate, the first exterior sidewall defining a plurality of first sidewall slots, the first exterior sidewall and the first top plate side cooperatively defining a plurality of first recesses that extend inwardly from the first exterior sidewall toward the longitudinal axis and downward from the first top plate side, each of the plurality of first recesses being bounded by a first bottom wall and a first recess wall extending from the first bottom wall to the first top plate side; and a second exterior sidewall extending downward from the top plate on the second side, the second exterior sidewall extending downward from the top plate, the second exterior sidewall defining a plurality of second sidewall slots, the second exterior sidewall and the second top plate side cooperatively defining a plurality of second recesses that extend inwardly from the second exterior sidewall toward the longitudinal axis and downward from the second top plate side, each of the plurality of second recesses being bounded by a second bottom wall and a second recess wall extending from the second bottom wall to the second top plate side;

a plurality of first fasteners, each projecting through a respective first bottom wall and into the first roof surface to secure the first top plate side to the first roof surface;

a plurality of second fasteners, each projecting through a respective second bottom wall and into the second roof surface to secure the second top plate side to the second roof surface;

a shingle placed over the top plate, the shingle covering at least one of the plurality of first recesses and at least one of the plurality of second recesses on opposite sides of the longitudinal axis;

a third fastener projecting through the shingle, the first top plate side and into the first roof surface to secure the shingle over the top plate, the third fastener distal from the plurality of first recesses; and a fourth fastener projecting through the shingle, the second top plate side and into the second roof surface to secure the shingle over the top plate, the fourth fastener distal from the plurality of second recesses;

wherein the first ridge vent comprises a first contiguous vented area, wherein the first exterior sidewall includes a first wall length that extends along the first exterior sidewall and linearly passes by the plurality of first recesses, wherein the first contiguous vented area includes a first venting area length that extends along the first exterior sidewall and extends around each of the plurality of first recesses, wherein the first venting area length is greater than the first wall length.

18. A ridge vent system for a roof of a building, the ridge vent system comprising:

a first ridge vent comprising:

a body including a first end, a second end opposite the first end, a first side, a second side opposite the first side, and a longitudinal axis, the body placed over an elongated opening along a ridge of a roof between a first roof surface and a second roof surface;

a top plate extending from the first side toward the second side and including a first top plate side and a second top plate side on opposite sides of the longitudinal axis;

a first exterior sidewall extending downward from the top plate on the first side, the first exterior sidewall extending downward from the top plate, the first exterior sidewall defining a plurality of first sidewall slots, the first exterior sidewall and the first top plate side cooperatively defining a plurality of first recesses that extend inwardly from the first exterior sidewall toward the longitudinal axis and downward from the first top plate side, each of the plurality of first recesses being bounded by a first bottom wall and a first recess wall extending from the first bottom wall to the first top plate side; and a second exterior sidewall extending downward from the top plate on the second side, the second exterior sidewall extending downward from the top plate, the second exterior sidewall defining a plurality of second sidewall slots, the second exterior sidewall and the second top plate side cooperatively defining a plurality of second recesses that extend inwardly from the second exterior sidewall toward the longitudinal axis and downward from the second top plate side, each of the plurality of second recesses being bounded by a second bottom wall and a second recess wall extending from the second bottom wall to the second top plate side;

a plurality of first fasteners, each projecting through a respective first bottom wall and into the first roof surface to secure the first top plate side to the first roof surface;

a plurality of second fasteners, each projecting through a respective second bottom wall and into the second roof surface to secure the second top plate side to the second roof surface;

a shingle placed over the top plate, the shingle covering at least one of the plurality of first recesses and at least one of the plurality of second recesses on opposite sides of the longitudinal axis;

a third fastener projecting through the shingle, the first top plate side and into the first roof surface to secure the shingle over the top plate, the third fastener distal from the plurality of first recesses; and a fourth fastener projecting through the shingle, the second top plate side and into the second roof surface to secure the shingle over the top plate, the fourth fastener distal from the plurality of second recesses;

wherein each of the plurality of first recess walls is U-shaped and opens away from the longitudinal axis;

wherein each of the plurality of second recess walls is U-shaped and opens away from the longitudinal axis, in a direction opposite the plurality of first recess walls.

19. The ridge vent system of claim 18 comprising:

a first contiguous vented area and a second contiguous vented area in the first ridge vent, an attic floor space disposed under the first roof surface and the second roof surface; and a plurality of additional ridge vents, each having a plurality of additional recesses forming a third contiguous vented area and a fourth contiguous vented area, wherein the first contiguous vented area, plus the second contiguous vented area, plus each third contiguous vented area, plus each fourth contiguous vented area equals an attic ventilation area, wherein the ridge vent system provides ventilation at a minimum of at least 1 square foot of attic ventilation area for every 300 square feet of attic floor space.

* * * * *